US005222145A

United States Patent [19]

Draffen

[11] Patent Number: 5,222,145

[45] Date of Patent: Jun. 22, 1993

[54] DUAL-CHAMBER MULTI-CHANNEL SPEAKER FOR SURROUND SOUND STEREO AUDIO SYSTEMS

[75] Inventor: Gary T. Draffen, Rancho Palos Verdes, Calif.

[73] Assignee: Culver Electronic Sales, Inc., Gardena, Calif.

[21] Appl. No.: 865,055

[22] Filed: Apr. 8, 1992

[51] Int. Cl.[5] ..... H04R 5/02

[52] U.S. Cl. ..... 381/24; 381/90; 381/188; 381/205; 181/145; 181/147

[58] Field of Search ..... 381/24, 27, 88, 89, 381/90, 188, 205; 181/144, 145, 147

[56] References Cited

U.S. PATENT DOCUMENTS

| | | | |
|---|---|---|---|
| 2,819,772 | 1/1958 | Bryan | 181/145 |
| 2,927,657 | 3/1960 | Patla et al. | 181/145 |
| 3,115,208 | 12/1963 | Smith | 181/144 |
| 3,417,203 | 12/1968 | Hafler | 381/27 |
| 3,637,938 | 1/1972 | Kuhlow et al. | 381/24 |
| 3,666,041 | 5/1972 | Engelhardt | 181/145 |
| 4,815,559 | 3/1989 | Shirley | 381/90 |

*Primary Examiner*—Forester W. Isen

*Attorney, Agent, or Firm*—Thomas I. Rozsa; Dong Chen

[57] ABSTRACT

The present invention is a dual-chamber multi-channel speaker for an audio system which has four stereo surround sound channels including a right front channel, a left front channel, a rear surround channel and a center channel. The preferred embodiment of the present invention speaker dual-chamber multi-channel speaker comprises a VCR shaped cabinet having a front chamber and a rear chamber, each being an independently sealed enclosure. A tweeter and two midranges are installed in the front chamber for producing sound effects of the center channel of the audio system. A subwoofer is installed in the rear chamber for producing low frequency sound effects of the right and left front channels. The center channel drivers are front-firing. The subwoofer may be up-firing or down-firing. The present invention dual-chamber multi-channel speaker further comprises a center channel crossover network for connecting the center channel drivers with the center channel of the audio system, and a separate front channels crossover network for connecting the subwoofer with the right and left front channels of the audio system.

38 Claims, 2 Drawing Sheets

DUAL-CHAMBER MULTI-CHANNEL SPEAKER FOR SURROUND SOUND STEREO AUDIO SYSTEMS

BACKGROUND OF THE INVENTION

1. Field of the Invention

The present invention relates to the field of modern electronic audio/video home entertainment systems. More particularly, the present invention relates to the field of speaker arrangements for stereo surround sound audio systems.

2. Description of the Prior Art

Modern electronic audio/video home entertainment systems have become very popular today. Many people desire to have complete audio/video systems installed at their own homes to make so called "home theaters" for enjoying individualized entertainment.

Referring to FIG. 1, there is shown a typical set up of a "home theater" entertainment system for user 10. The system includes a television (TV) set 12 and an audio/video components rack 14. The TV 12 may be a big screen or projection TV. The audio/video components rack 14 may comprise various audio/video components. One critical component is a receiver 16 which serves as the control center of all the audio and video components of the entire audio/video system. The audio components of the rack 14 may include a compact disc (CD) player, cassette tape recorder/player, digital audio tape (DAT) recorder/player, and turntable. The video components of the rack 14 may include video cassette recorder (VCR) and laser disc (LD) player.

The home theater system further comprises a speaker system, including a right front speaker 22, a left front speaker 24 and two rear speakers 26, all connected to receiver 16 by wires 28. The term "speaker" used throughout this application does not refer to a single loudspeaker, but rather a unit of loudspeakers. A "speaker" used in this sense typically comprises three basic parts. The first part includes one or more loudspeaker drivers, such as a "tweeter" which reproduces high frequency sounds, a "midrange" which reproduces mid-frequency sounds, and a "subwoofer" which reproduces low frequency sounds. The second part includes a crossover network which divides the input frequencies into two or more bands for their appropriate drivers. The third part is an acoustic cabinet which houses the loudspeaker drivers.

Therefore, in this application the term "speaker" refers to the independent cabinet in which one or more drivers and crossover networks are installed. The term "driver" then refers to the single push-pull loudspeaker driver such as a tweeter, a midrange, a full-range, a woofer and a subwoofer.

Right front speaker 22 shown in FIG. 1 is a typical example of a traditional "3-way" speaker. It has a rectangular box shaped cabinet 30. Three drivers are mounted inside the cabinet 30. The three drivers are: tweeter 32, midrange 34 and subwoofer 36. The physical dimensions of the drivers are often measured by the diameters of their respective diaphragms. For a home stereo system, the size of the tweeter 32 may be between ½ and 2 inches, the size of the midrange 34 may be between 3½ and 6 inches, and the size of the subwoofer may be between 6 and 10 inches. The right front speaker 22 also includes a crossover network which is usually located on the back side of the speaker and has two terminals for accommodating wires 28.

Early home stereo systems reproduce stereo sound effect through two separate channels: a right front channel and a left front channel. The advanced home stereo systems now typically reproduce surround sound effect in four separate channels. Two more channels are provided in addition to the right and left front channels, including a rear surround channel and a center channel. The rear surround channel is used primarily for time-delay surround effect, and the center channel is used primarily for on-screen dialogue. Almost all CDs, LDs and DAT music tapes, most VCR movie tapes and audio cassette music tapes, and many TV and radio programs broadcast on network or cable systems are now encoded with all four channels.

In the systems shown in FIG. 1, right front speaker 22 is connected to the right front channel of receiver 16, left front speaker 24 is connected to the left front channel of receiver 16, and the two rear speakers 26 are connected to the rear surround channel of the receiver 16. The speaker built into TV 12 may be used as a center channel speaker and connected to the center channel of receiver 16, if input terminals are provided on TV 12. Otherwise a separate speaker may be used as the center channel speaker (not shown).

There are two common problems in most of the conventional home entertainment systems. The first common problem is that the conventional home entertainment systems usually has no separate center channel speaker. Additional center channel speakers become more desirable because they produce much clearer sound effect for dialogue, and deliver more realistic sound effects because the sound is coming from the center, where the TV is placed and where the sound of dialogue is supposed to come from. Separate center channel speakers also become more desirable because the speakers built into TVs usually produce less effective sound effects than separate speakers. Some receivers in conventional home entertainment systems have a so-called "phantom" mode to solve the problem of having no center speaker. In such "phantom" mode the signal of the center channel is sent to the two front speakers. The two front speakers then reproduce synthesized sound for the non-existing center channel speaker. However, the quality of the synthesized "phantom" sound produced by the front speakers cannot be as good as the quality of the real sound produced by a real center channel speaker.

The second common problem is that in most of the conventional home entertainment systems, each front speaker is a large cabinet housing directional and non-directional drivers. The tweeter and midrange drivers are directional drivers which require careful placement of the front speakers so their sound can be properly delivered to the user. On the other hand, the subwoofers are non-directional drivers and may be placed at any location. Because the front speakers include directional drivers, they have to be placed in certain locations. However, their large physical dimensions often make it hard to arrange the speaker with existing furniture. The placement of the speakers are often awkward and alter the arrangement and appearance of the user's living room dramatically. Some home entertainment systems have utilized a so-called "satellite" speaker system to solve the placement problem. In such satellite speaker system the directional and non-directional drivers in each of the front speakers are separated and installed in a separate cabinet. The smaller-sized directional drivers, including tweeter and midrange, are installed in a small cabinet. The larger-sized non-directional driver, the subwoofer, is installed in a large cabinet. The small cabinets of the directional drivers are the "satellite" of the speaker system. Since they are smaller, it is much easier to place them according to the set up and location of the user's listening area. The large subwoofer cabinets, on the other hand, do not have to be placed at a certain location and may even be placed behind furniture. However, having many separate speaker cabinets undoubtedly increases the complexity of installation and maintenance of the speaker system.

Therefore, it will be desirable to provide surround sound stereo audio systems for people's home theater entertainment systems, which not only provide additional and separate center channel speakers, but also provide effective as well as efficient arrangement of the speakers.

SUMMARY OF THE INVENTION

The present invention is a dual-chamber multi-channel speaker for surround sound stereo audio systems. The present invention dual-chamber multi-channel speaker provides an effective as well as efficient speaker arrangement for people's home theater audio/video entertainment systems.

It is known that an advanced surround sound stereo audio system should be able to produce surround sound effects through four separate channels: two front channels, a rear surround channel and a center channel. The conventional surround sound stereo audio systems usually only have front speakers for front channels and rear speakers for rear surround channel, but no speaker for the center channel. The front speakers typically are big upright cabinets containing both non-directional drivers such as a subwoofer and directional drivers such as the tweeter and midrange. Since it is hard to arrange the placement of the large front speakers with other furniture, the large front speakers sometimes are replaced by smaller directional satellite speakers and a separate subwoofer speaker.

It has been discovered, according to the present invention, that using a separate center channel speaker can provide the best results in reproducing the sound effects of the center channel. It is also beneficial to separate the directional and non-directional drivers of the front speakers and install the directional drivers into smaller satellite speakers. However, adding center channel speakers and replacing the front speakers with satellite speakers and subwoofer speakers increases the number of components in the speaker system. This not only complicates the installation and maintenance of the speaker system, but also increases the cost of building extra cabinets for the speaker system.

It is therefore an object of the present invention to provide a speaker system for people's home theater audio/video entertainment systems, where the speaker system produces excellent surround sound effects, yet keeps the number of speakers as small as possible to not only simplify the installation and maintenance of the speaker system but also reduce the cost of the speaker system.

It is another object of the present invention to provide a speaker system for people's home theater audio/video entertainment systems, where the speaker system comprises separate and independent drivers for each of the four surround sound channels including the right front channel, the left front channel, the rear surround channel and the center channel.

It is also an object of the present invention to provide a speaker system for people's home theater audio/video entertainment systems, where the speaker system comprises both directional drivers such as tweeters and midrange and non-directional drivers for each one of the two front channels, but the directional and non-directional drivers are separately installed in discrete speakers, so that it is more convenient to place and adjust the orientation of the smaller speakers which have the directional drivers.

Moreover, it is a primary object of the present invention to provide a dual-chamber multi-channel speaker for people's home theater audio/video entertainment systems, which speaker comprises multiple drivers including tweeter and midrange for the center channel and subwoofer for the right and left front channels, all contained in a dual-chamber cabinet. With this dual-chamber multi-channel speaker, the two non-directional subwoofers of the right and left front channels are replaced by one single subwoofer and this single subwoofer is installed in the same cabinet with the center channel drivers.

It is an additional object of the present invention to provide a cabinet for the present invention speaker, where the interior configuration of the cabinet properly forms two sealed enclosures each having appropriate dimensions, so that the drivers in both chambers can effectively and efficiently produce excellent sound effects.

It is a further object of the present invention to provide a cabinet for the present invention speaker, where the exterior configuration of the cabinet has the same configuration and appearance as other audio/video components of people's home theater audio/video entertainment systems, so that the present invention speaker can be suitably stacked with the other audio/video components.

Described generally, the present invention is a dual-chamber multi-channel speaker. The present invention speaker has a multiplicity of drivers for the different surround sound channels. The multiplicity of drivers are installed in a dual-chamber cabinet. More particularly, the multiple drivers include a tweeter and a midrange (or full-range) for the center channel of the four surround sound channels, as well as a subwoofer for the right and left front channels of the four surround sound channels. The cabinet of the present invention speaker has a smaller front chamber and a larger rear chamber. Each chamber forms an independent sealed enclosure. The center channel drivers are installed in the front chamber for delivering the sound effects of the center channel to a listener in front of the dual-channel speaker. The subwoofer for the front channels is installed in the rear chamber for delivering the low frequency sound effects of the front channels. The size of each chamber is finely adjusted for producing superior sound effects in the center channel and the two front channels.

Described alternatively, the present invention is a stereo surround sound speaker system for home theater audio/video entertainment systems. The present invention speaker system produces surround sound effects in all four surround sound channels including the center channel, the right front channel, the left front channel and the rear surround channel. The speaker system basically includes a dual-chamber multi-channel speaker, a right front satellite speaker, a left front satellite speaker and two rear surround sound speakers. The dual-chamber multi-channel speaker will have tweeter and midrange drivers installed in a front chamber for the center channel, and subwoofer driver installed in a rear chamber for the two front channels. The right front satellite speaker will have tweeter and midrange drivers for the right front channel. The left front satellite speaker will have tweeter and midrange drivers for the left front channel. Finally, the two rear speakers will have drivers for the rear surround channel. Therefore, the present invention speaker system can effectively and efficiently produce excellent sound effects for all four surround channels.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
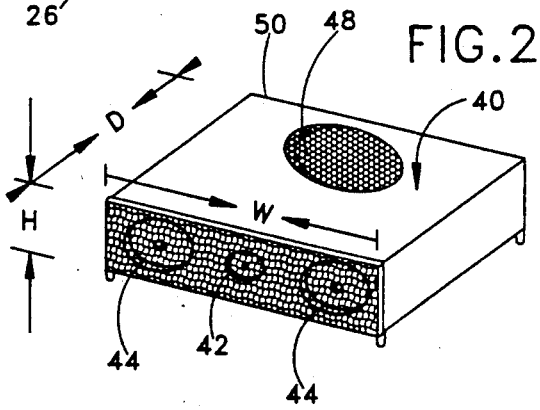
FIG. 2 is a perspective view of a preferred embodiment of the present invention dual-chamber multi-channel speaker for the surround sound speaker systems of home theater audio/video entertainment systems.

Referring to FIG. 2, there is shown at 40 a perspective view of a preferred embodiment of the present invention dual-chamber multi-channel speaker for the surround sound speaker systems of home theater audio/video entertainment systems. Typically the present invention speaker 40 comprises four drivers for three channels: three drivers for the center channel and one driver for the right and left front channels. The three drivers for the center channel are a tweeter 42, a right midrange 44 and a left midrange 46. The two midrange 44 and 46 may be replaced by two full-range drivers. The one driver for the right and left front channels is a subwoofer 48. All four drivers are installed in a cabinet 50 preferably made of wooden materials.

The exterior configuration of the cabinet 50 of the present invention speaker 40 is generally the same as the standard rectangular box shaped configuration of other audio/video components, such as VCRs, which are placed horizontally. For example, in a particular embodiment of the present invention, the width "W" of the cabinet 50 is approximately seventeen inches (17"), the depth "D" of the cabinet 50 is also approximately seventeen inches (17"), and the height "H" of the cabinet 50 is approximately five inches (5").

In the preferred embodiment, the tweeter 42 and two midrange 44 and 46 for the center channel are mounted on the front end of the cabinet 50 and facing toward the listener. This arrangement is often called the "front firing" arrangement. The subwoofer 48 is mounted on the top side of the cabinet 50 and facing upwardly. This arrangement is often called the "up firing" arrangement.

Figure 3:
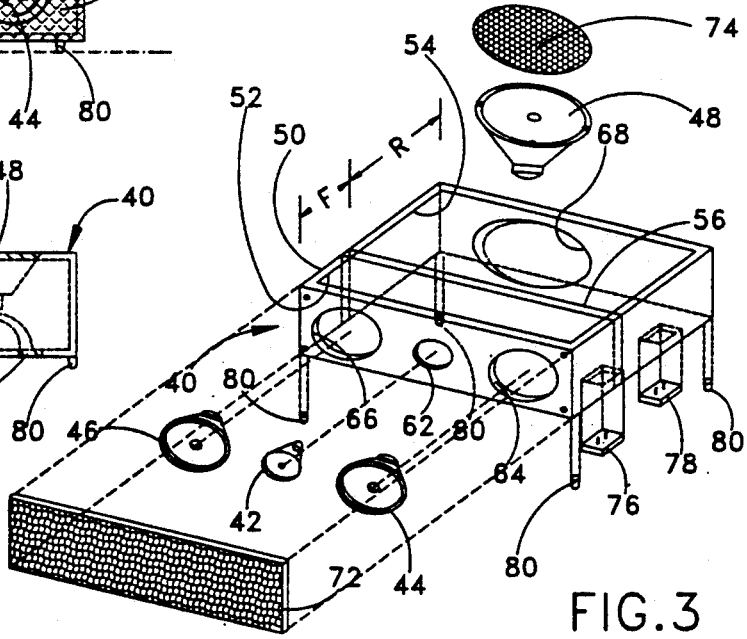
FIG. 3 is an exploded view of the preferred embodiment of the present invention dual-chamber multi-channel speaker for the surround sound speaker systems of home theater audio/video entertainment systems.

Referring to FIG. 3, there is shown an exploded view of the preferred embodiment of the present invention dual-chamber multi-channel speaker 40. The interior of the cabinet 50 is divided into a front chamber 52 and a rear chamber 54. The front chamber 52 and the rear chamber 54 are divided by a partition wall 56. The front chamber 52 and the rear chamber 54 are completely independent of each other.

In the preferred embodiment of the present invention, both the front chamber 52 and the rear chamber 54 have acoustic suspension designs. That means the front chamber 52 is a completely sealed air-tight enclosure, and the rear chamber 54 is also a completely sealed air-tight enclosure. The acoustic suspension design produces more tightly controlled and more accurate sound effects. However, it is understood that either the front chamber 52 or the rear chamber 54 may have bass reflex design. That means the front chamber 52 may be a vented enclosure with an air outlet port, or the rear chamber 54 may be a vented enclosure with an air outlet port, or both the front chamber 52 and the rear chamber 54 are vented enclosures. The bass reflex design produces more bass output and thus enhances the low frequency sound effects. Particularly the rear chamber 54 for the subwoofer 48 may have an air outlet port carefully cut to make it a vented enclosure of the bass reflex design.

The size of the front chamber 52 and rear chamber 54 are carefully determined. The front chamber 52 must have enough space for the tweeter 42 and the midranges 44 and 46, and particularly for the midranges 44 and 46. The rear chamber 54 must have enough space for the subwoofer 48. However, since the subwoofer 48 is usually a larger driver, the rear chamber needs to be larger for adequately accommodating the lower frequency sound waves. In the preferred embodiment, the tweeter 42 is a one inch (1") cone or dome driver, the right midrange 44 and the left midrange 46 are both four-and-half inch (4½") cone drivers, and the subwoofer 48 is a six-and-half inch (6½") cone driver. Accordingly, the respective depth "F" of the front chamber 52 is approximately five inches (5") and the respective depth "R" of the rear chamber 54 is approximately twelve inches (12"). Therefore the volume ratio of the front chamber 52 to the rear chamber 54 is about one to three (1:3). It is noted that these dimensions can vary. In addition, the center channel drivers 44 and 46 may be full-range drivers, and the front channel driver 48 may be a woofer.

On the front end of the front chamber 52 there are three openings 62, 64 and 66. The middle opening 62 is smaller because it is made for installing the tweeter 42. The right opening 64 and the left opening 66 are larger because they are made for installing the right midrange 44 and left midrange 46 respectively. The tweeter 42 and the midranges 44 and 46 are attached to the front end of the cabinet 50 by suitable conventional fasteners such as screws.

The sizes of these front openings are determined by the sizes of the respective drivers 42, 44 and 46. For example, if the size of the tweeter 42 is one inch (1"), then the diameter of the center opening 62 is approximately one inch (1"). Similarly, if the sizes of the right midrange 44 and the left midrange 46 are both four-and-half inches (4½"), then the diameters of the right and left front openings 64 and 66 are approximately four-and-half inches (4½").

On the top side of the cabinet 50 there is an opening 68 at the center of the rear chamber 54, which is made for installing the subwoofer 48. The subwoofer 48 is attached to the top side of the cabinet 50 also by suitable conventional fasteners such as screws. The size of the top opening 68 is determined by the sizes of the subwoofer 48. For example, if the size of the subwoofer 48 is six-and-half inches (6½"), then the diameter of the top opening 68 is approximately six-and-half inches (6½").

Once all drivers are installed, appropriate grills 72 and 74 are attached to the front end and top side of the cabinet respectively. The front grill 72 will have a rectangular configuration and conform with the dimensions of the front end of the cabinet 50. It will be approximately seventeen inches (17") wide and five inches (5") high. The front grill is preferably made of soft fabric material. The top grill 74 will have a round configuration and conform to the dimension of the subwoofer 48. If the size of the subwoofer 48 is six-and-half inches (6½"), then the diameter of the top grill 74 is approximately six-and-half inches (6½"). It is preferable to have the top grill level with the top surface of the cabinet 50. In addition, the crossover network 76 for the center channel drivers are installed at the bottom side of the cabinet 50 and located in the front chamber 52, and the crossover network 78 for the subwoofer is also installed at the bottom side of the cabinet 50 but located in the rear chamber 54.

Figure 4:
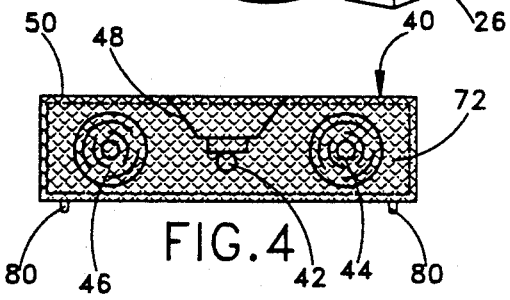
FIG. 4 is a front end view of the preferred embodiment of the present invention dual-chamber multi-channel speaker for the surround sound speaker systems of home theater audio/video entertainment systems.
Figure 6:
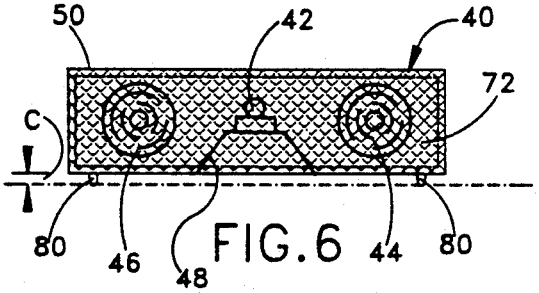
FIG. 6 is a front end view of an alternative embodiment of the present invention dual-chamber multi-channel speaker for the surround sound speaker systems home theater audio/video entertainment systems.
Figure 5:
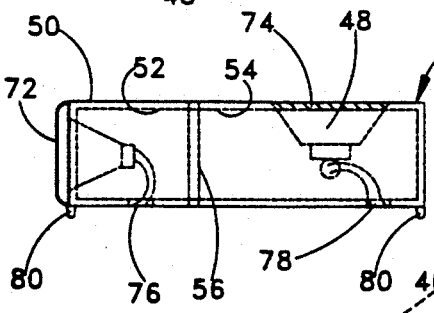
FIG. 5 is a side cross-sectional view of the preferred embodiment of the present invention dual-chamber multi-channel speaker for the surround sound speaker systems home theater audio/video entertainment systems.

Referring to FIGS. 4 and 5, there is shown the preferred embodiment of the present invention dual-chamber multi-channel speaker 40, as it is completely assembled. It is noted that in this preferred embodiment, the subwoofer 48 is installed on the top side of the cabinet 50, therefore it is "up-firing." However, in an alternative embodiment as shown in FIG. 6, the subwoofer can also be "down-firing," i.e., installed on the bottom side of the cabinet 50. The four cabinet stands 80 will keep a clearance "C" between the bottom side of the cabinet 50 and the surface upon which the present invention speaker 40 is placed. Such a surface may be the top surface of a large screen TV or the top surface of other audio/device components such as a VCR. The preferred clearance C is approximately one inch (1"), which leaves enough air space for the sound wave generated by the down-firing subwoofer.

Figure 1:
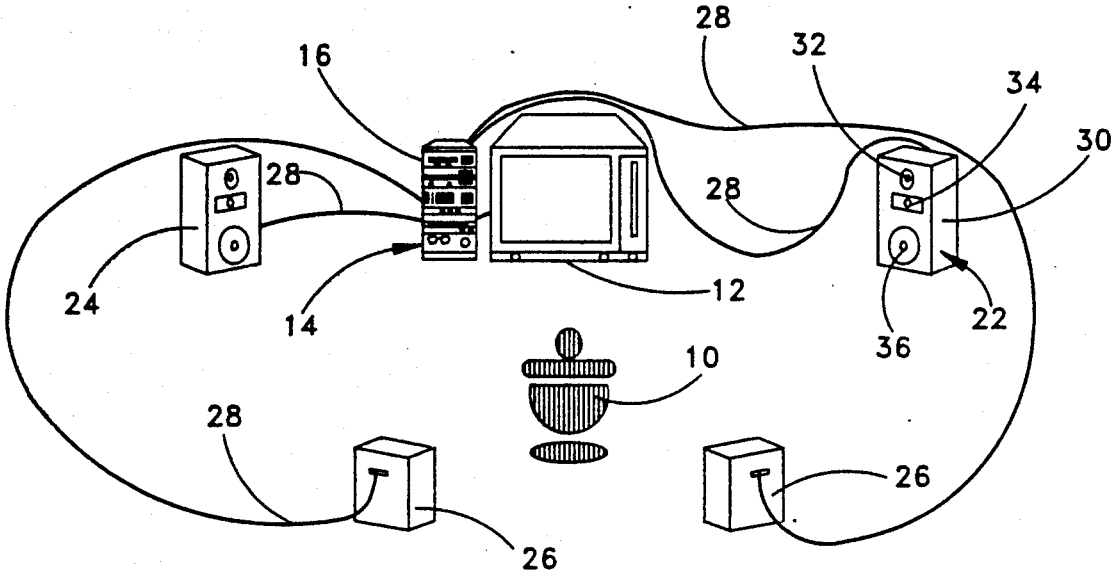
FIG. 1 (PRIOR ART)
FIG. 1 is a perspective view of the typical arrangement of a prior art surround sound speaker system for home theater audio/video entertainment systems.
Figure 8:
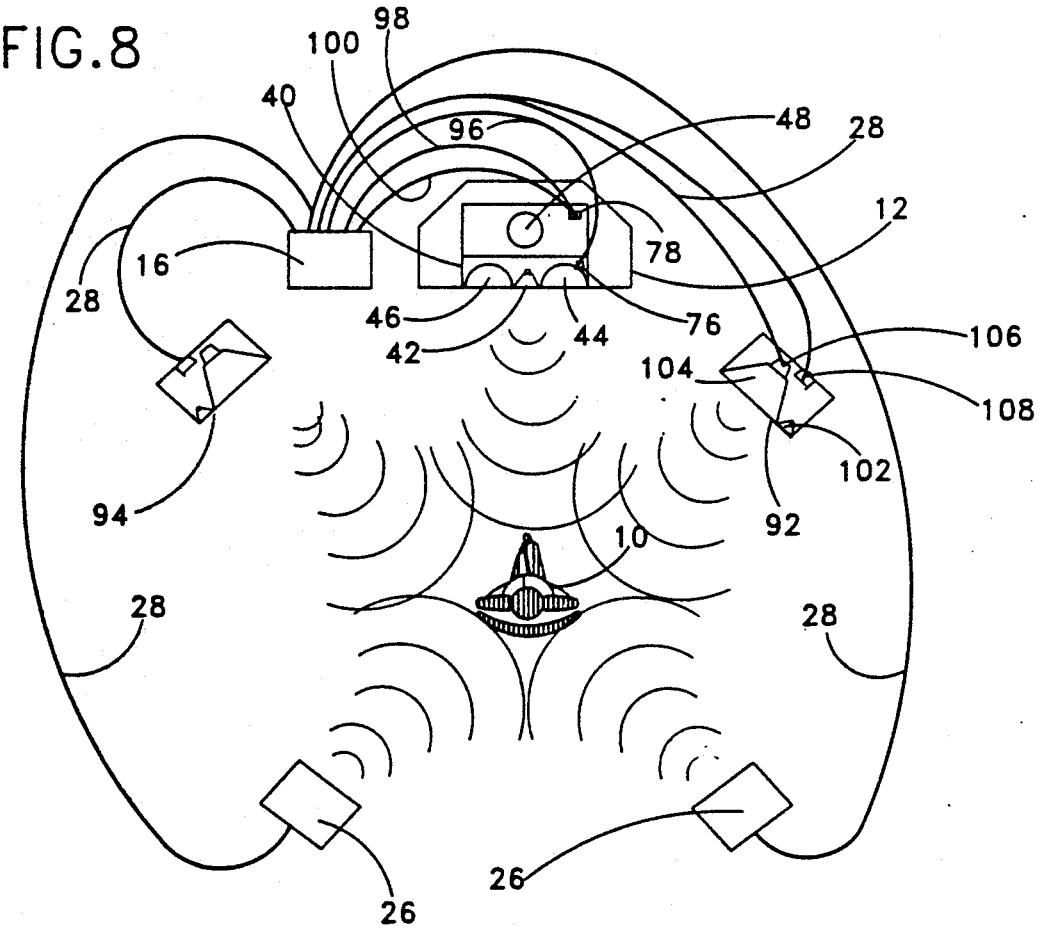
FIG. 8 is a top illustrative view of the typical arrangement of the present invention surround sound speaker system, including the dual-chamber multi-channel speaker, for home theater audio/video entertainment systems.
Figure 7:
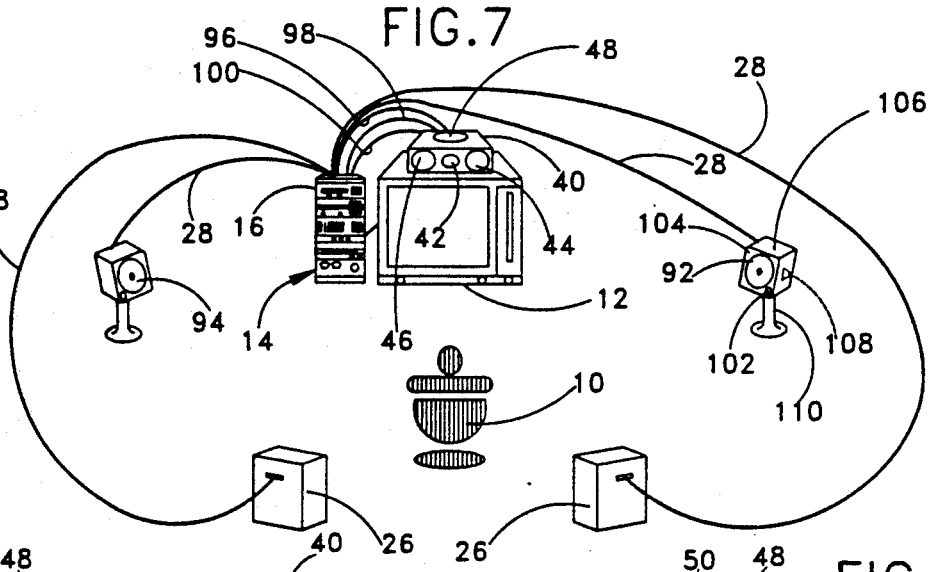
FIG. 7 is a perspective view of a typical arrangement of the present invention surround sound speaker system, including the dual-chamber multi-channel speaker, for home theater audio/video entertainment systems.

Referring to FIGS. 7 and 8, there is shown a perspective view of a typical arrangement of the present invention surround sound speaker system, including the dual-chamber multi-channel speaker 40, for people's home theater audio/video entertainment systems. The home entertainment system again comprises a large screen TV 12 and an audio/video rack 14 which includes a receiver 16. The receiver has outputs for four surround sound channels including right front channel, left front channel, rear surround channel and center channel. The speaker system comprises five speakers: a dual-chamber multi-channel speaker 40, a right front speaker 92, a left front speaker 94 and two rear surround speakers 26.

Instead of using two large-sized upright front speakers, the present invention speaker system uses two small satellite speakers 92 and 94 as the front speakers. The large upright front speakers can be replaced by small satellite speakers because the directional and non-directional drivers in the conventional front speakers are separated. For example, the right front satellite speaker 92 only comprises a tweeter 102 and a midrange or full-range 104. Since these drivers are usually smaller, they can be installed in a smaller cabinet 106. Since the size of the cabinet 106 is smaller than the conventional upright front speaker, it is much easier to place and orient the right front satellite speaker 92. It may be supported on a swivel base 110, or suspended on the wall or from the ceiling of the user's living room. This is also true for the left front satellite speaker 94.

The non-directional drivers of the conventional front speakers are now replaced by the non-directional subwoofer 48 of the dual-chamber multi-channel speaker 40. Since the subwoofer 48 is non-directional, it can be located at any location. Hence it is perfectly alright to installed it in the rear chamber of the speaker 40, which is in turn placed right in front of the user 10, because the center channel drivers are installed in its front chamber.

The speaker system works as follows. The center channel signals are sent from the receiver 16 to the front chamber crossover network 76 of the speaker 40 through wire 96, so that the tweeter 42 and the two midranges 44 and 46 of the speaker 40 can produce sound effects of the center channel. The right front channel signals are sent from the receiver 16 to the crossover network 108 of the right front satellite speaker 92, so that the tweeter 102 and midrange 104 of the right front satellite speaker can produce high and middle frequency sound effects of the right front channel. The high and middle frequency sound effects of the left front channel are produced by the left front satellite speaker 94 in similar fashion. The right front channel signals and the left front channel signals are also sent from the receiver 16 to the rear chamber crossover network 78 through wires 98 and 100 respectively, so that the subwoofer 48 of the speaker 40 can produce low frequency sound effects of the right and left front channels. Finally, the rear surround sound effects are produced by the two rear surround speakers 26.

The present invention speaker system has many advantageous features, including: (a) its new speaker utilizes a dual chamber cabinet, where each chamber is an independent enclosure, the drivers installed in the two chambers are connected to different channels and have their own crossover network respectively; (b) it provides superior sound effects in all four surround sound channels including the center channel through actual center channel drivers, rather than using the front speakers in a "phantom" mode; (c) it separates the directional and non-directional drivers of the front speakers and installs them in separate speakers respectively, and replaces the inconvenient large front speakers with small satellite speakers, thus making the placement and orientation of the front speakers much easier; and (d) is uses a single subwoofer to replace the two subwoofers of the conventional right and left front speakers, and installs the single subwoofer in the same cabinet of the center channel drivers, therefore a separate and independent cabinet for the single subwoofer is eliminated and the cost of the speaker system is reduced.

Defined in detail, the present invention is a speaker for an audio system having four stereo surround sound channels including a right front channel, a left front channel, a rear surround channel and a center channel, the speaker comprising: (a) a rectangular shaped hollow cabinet made of wooden material, where both the width and the depth of the cabinet are approximately seventeen inches (17") and the height of the cabinet is approximately five inches (5"); (b) said cabinet being assembled by six flat rectangular panels including a top panel, a bottom panel, a front panel, a rear panel and two opposite laterial side panels; (c) said cabinet further comprising an interior partition panel which is parallel to said front and end panels and divides the interior space of said cabinet into two independent hollow chambers including a front chamber and a rear chamber, where the depth of said front chamber is approximately five inches (5") and the depth of said rear chamber is approximately twelve inches (12"); (d) a one inch (1") tweeter, a right four-and-half inch (4½") midrange and a left four-and-half inch (4½") midrange for producing sound effects of said center channel; (e) said front panel of said cabinet having a center opening, a right opening and a left opening all aligned longitudinally, where the diameter of the center opening is approximately one inch (1") for accommodating said tweeter, the diameter of the right and left openings are both approximately four-and-half inches (4½") for accommodating said right and left midranges respectively; (f) means for attaching said tweeter and said right and left midranges to said front panel of said cabinet; (g) said front chamber becoming an air-tight sealed enclosure after said tweeter and said right and left midranges are attached to said front panel of said cabinet; (h) a six-and-half inch (6½") subwoofer for producing low frequency sound effects of said right front channel and said left front channel; (i) said top panel of said cabinet having a top opening positioned at the center of said rear chamber, where the diameter of the top opening is approximately six-and-half inches (6½") for accommodating said subwoofer; (j) means for attaching said subwoofer to said top panel of said cabinet; (k) said rear chamber becoming an air-tight sealed enclosure after said subwoofer is attached to said top panel of said cabinet; (l) a center channel crossover network located in said front chamber and attached to said bottom panel of said cabinet for connecting said tweeter and said right and left midranges with said center channel; and (m) a front channels crossover network located in said rear chamber and attached to said bottom panel of said cabinet for connecting said subwoofer with said right and left front channels; (n) whereby said tweeter and said right and left midranges located in said front chamber of said speaker can produce sound effects of said center channel of said audio system, and said subwoofer located in said rear chamber of said speaker can produce low frequency sound effects of said right and left front channels of said audio system.

Defined broadly, the present invention is a speaker for an audio system having four stereo surround sound channels including a right front channel, a left front channel, a rear surround channel and a center channel, the speaker comprising: (a) a generally rectangular shaped hollow cabinet made of wooden material having a top side, a bottom side, a front end, a rear end and two opposite lateral sides; (b) said cabinet further comprising two independent hollow chambers including a front chamber and a rear chamber; (c) a tweeter, a right midrange and a left midrange for producing sound effects of said center channel; (d) said front end of said cabinet having a center opening to accommodate said tweeter, a right opening and a left opening for accommodating said right and left midranges respectively, the openings all aligned longitudinally; (e) means for installing said tweeter and said right and left midranges in said front chamber corresponding to said center opening and said right and left openings on said front end of said cabinet respectively; (f) said front chamber becoming an air-tight sealed enclosure after said tweeter and said right and left midranges are installed in said front chamber; (g) a subwoofer for producing low frequency sound effects of said right front channel and said left front channel; (h) said top side of said cabinet having a horizontal opening positioned approximately the center of said rear chamber for accommodating said subwoofer; (i) means for installing said subwoofer in said rear chamber corresponding to said horizontal opening on said top side of said cabinet; (j) said rear chamber becoming an air-tight sealed enclosure after said subwoofer is installed in said rear chamber; (k) a center channel crossover network located in said front chamber and attached to said bottom side of said cabinet for connecting said tweeter and said right and left midranges with said center channel; and (l) a front channels crossover network located in said rear chamber and attached to said bottom side of said cabinet for connecting said subwoofer with said right and left front channels; (m) whereby said tweeter and said right and left midranges located in said front chamber of said speaker can produce sound effects of said center channel of said audio system, and said subwoofer effects of said right and left front channels of said audio system.

Defined more broadly, the present invention is a speaker for an audio system having four stereo surround sound channels including a right front channel, a left front channel, a rear surround channel and a center channel, the speaker comprising: (a) a generally rectangular shaped hollow cabinet having a top side, a bottom side, a front end, a rear end and two opposite lateral sides; (b) said cabinet further comprising two independent hollow chambers including a front chamber and a rear chamber; (c) a high frequency driver, a right mid-frequency driver and a left mid-frequency driver for producing sound effects of said center channel; (d) said front end of said cabinet having a center opening to accommodate said high frequency driver, a right opening and a left opening for accommodating said right and left mid-frequency drivers respectively, the openings all aligned longitudinally; (e) means for installing said high frequency driver and said right and left mid-frequency drivers in said front chamber corresponding to said center opening and said right and left openings on said front end of said cabinet respectively; (f) a low frequency driver for producing low frequency sound effects of said right and left front channels; (g) said rear chamber of said cabinet having a horizontal opening positioned at approximately the center of said rear chamber for accommodating said low frequency driver; (h) means for installing said low frequency driver in said rear cabinet corresponding to said horizontal opening of said rear chamber; (i) a center channel crossover network located in said front chamber of said cabinet for connecting said high frequency driver and said right and left mid-frequency drivers with said center channel; and (j) a front channels crossover network located in said rear chamber of said cabinet for connecting said low frequency driver with said right and left front channels; (k) whereby said high frequency driver and said right and left mid-frequency drivers located in said front chamber of said speaker can produce sound effects of said center channel of said audio system, and said low frequency driver located in said rear chamber of said speaker can produce low frequency sound effects of said right and left front channels of said audio system.

Defined even more broadly, the present invention is a speaker for an audio system having four stereo surround sound channels including a right front channel, a left front channel, a rear surround channel and a center channel, the speaker comprising: (a) a cabinet having at least two independent hollow chambers; (b) at least one normal frequency driver installed in one of said at least two independent chambers for producing sound effects of said center channel; (c) at least one low frequency driver installed in the other one of said at least two independent chambers for producing low frequency sound effects of said right and left front channels; (d) a center channel crossover network for connecting said at least one normal frequency driver with said center channel; and (e) a front channels crossover network for connecting said at least one low frequency driver with said right and left front channels; (f) whereby said at least one normal frequency driver can produce sound effects of said center channel of said audio system, and said at least one low frequency driver can produce low frequency sound effects of said right and left front channels of said audio system.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A speaker for an audio system having four stereo surround sound channels including a right front channel, a left front channel, a rear surround channel and a center channel, the speaker comprising:

a. a generally rectangular shaped hollow cabinet made of wooden material having a top side, a bottom side, a front end, a rear end and two opposite lateral sides;

b. said cabinet further comprising two independent hollow chambers including a front chamber and a rear chamber;

c. a tweeter, a right midrange and a left midrange for producing sound effects of said center channel;

d. said front end of said cabinet having a center opening to accommodate said tweeter, a right opening and a left opening for accommodating said right and left midranges respectively, the openings all aligned longitudinally;

e. means for installing said tweeter and said right and left midranges in said front chamber corresponding to said center opening and said right and left openings on said front end of said cabinet respectively;

f. said front chamber becoming an air-tight sealed enclosure after said tweeter and said right and left midranges are installed in said front chamber;

g. a subwoofer for producing low frequency sound effects of said right front channel and said left front channel;

h. said top side of said cabinet having a horizontal opening positioned at approximately the center of said rear chamber for accommodating said subwoofer;

i. means for installing said subwoofer in said rear chamber corresponding to said horizontal opening on said top side of said cabinet;

j. said rear chamber becoming an air-tight sealed enclosure after said subwoofer is installed in said rear chamber;

k. a center channel crossover network located in said front chamber and attached to said bottom side of said cabinet for connecting said tweeter and said right and left midranges with said center channel; and l. a front channels crossover network located in said rear chamber and attached to said bottom side of said cabinet for connecting said subwoofer with said right and left front channels;

m. whereby said tweeter and said right and left midranges located in said front chamber of said speaker can produce sound effects of said center channel of said audio system, and said subwoofer located in said rear chamber of said speaker can produce low frequency sound effects of said right and left front channels of said audio system.

2. The invention as defined in claim 1 wherein both the width and the depth of said cabinet are approximately seventeen inches (17") and the height of said cabinet is approximately five inches (5").

3. The invention as defined in claim 1 wherein the depth of said front chamber of said cabinet is approximately five inches (5") and the depth of said rear chamber of said cabinet is approximately twelve inches (12").

4. The invention as defined in claim 1 wherein said tweeter is a one inch (1") tweeter.

5. The invention as defined in claim 1 wherein said right and left midranges are both four-and half inch (4½") midranges.

6. The invention as defined in claim 4 wherein the diameter of said center opening on said front end of said cabinet for accommodating said one inch (1") tweeter is approximately one inch (1").

7. The invention as defined in claim 5 wherein the diameters of said right and left openings on said front end of said cabinet for accommodating said both four-and-half inches (4½") midranges are both approximately four-and-half inches (4½").

8. The invention as defined in claim 1 further comprising a generally rectangular shaped flat grill attachable to said front end of said cabinet for protecting said tweeter and said right and left midranges.

9. The invention as defined in claim 1 further comprising a round shaped flat grill attachable to said top side of said cabinet for protecting said subwoofer.

10. The invention as defined in claim 1 further comprising standing members attachable to said bottom side of said cabinet for elevating said cabinet.

11. A speaker for an audio system having four stereo surround sound channels including a right front channel, a left front channel, a rear surround channel and a center channel, the speaker comprising:

a. a rectangular shaped hollow cabinet made of wooden material, where both the width and the depth of the cabinet are approximately seventeen inches (17") and the height of the cabinet is approximately five inches (5");

b. said cabinet being assembled by six flat rectangular panels including a top panel, a bottom panel, a front panel, a rear panel and two opposite lateral side panels;

c. said cabinet further comprising an interior partition panel which is parallel to said front and end panels and divides the interior space of said cabinet into two independent hollow chambers including a front chamber and a rear chamber, where the depth of said front chamber is approximately five inches (5") and the depth of said rear chamber is approximately twelve inches (12");

d. a one inch (1") tweeter, a right four-and-half inch (4½") midrange and a left four-and-half inch (4½") midrange for producing sound effects of said center channel;

e. said front panel of said cabinet having a center opening, a right opening and a left opening all aligned longitudinally, where the diameter of the center opening is approximately one inch (1") for accommodating said tweeter, the diameter of the right and left openings are both approximately four-and-half inches (4½") for accommodating said right and left midranges respectively;

f. means for attaching said tweeter and said right and left midranges to said front panel of said cabinet;

g. said front chamber becoming an air-tight sealed enclosure after said tweeter and said right and left midranges are attached to said front panel of said cabinet;

h. a six-and-half inch (6½") subwoofer for producing low frequency sound effects of said right front channel and said left front channel;

i. said top panel of said cabinet having a top opening positioned at the center of said rear chamber, where the diameter of the top opening is approximately six-and-half inches (6½") for accommodating said subwoofer;

j. means for attaching said subwoofer to said top panel of said cabinet;

k. said rear chamber becoming an air-tight sealed enclosure after said subwoofer is attached to said top panel of said cabinet;

l. a center channel crossover network located in said front chamber and attached to said bottom panel of said cabinet for connecting said tweeter and said right and left midranges with said center channel; and m. a front channels crossover network located in said rear chamber and attached to said bottom panel of said cabinet for connecting said subwoofer with said right and left front channels;

n. whereby said tweeter and said right and left midranges located in said front chamber of said speaker can produce sound effects of said center channel of said audio system, and said subwoofer located in said rear chamber of said speaker can produce low frequency sound effects of said right and left front channels of said audio system.

12. The invention as defined in claim 11 further comprising a rectangular shaped flat grill attachable to said front panel of said cabinet for protecting said tweeter and said right and left midranges.

13. The invention as defined in claim 11 further comprising a round shaped flat grill attachable to said top panel of said cabinet for protecting said subwoofer.

14. The invention as defined in claim 11 further comprising four standing members attachable to four corners of said bottom panel of said cabinet for elevating said cabinet.

15. The invention as defined in claim 14 wherein the height of said standing members is approximately one inch (1").

16. A speaker for an audio system having four stereo surround sound channels including a right front channel, a left front channel, a rear surround channel and a center channel, the speaker comprising:

a. a generally rectangular shaped hollow cabinet having a top side, a bottom side, a front end, a rear end and two opposite lateral sides;

b. said cabinet further comprising two independent hollow chambers including a front chamber and a rear chamber;

c. a high frequency driver, a right mid-frequency driver and a left mid-frequency driver for producing sound effects of said center channel;

d. said front end of said cabinet having a center opening to accommodate said high frequency driver, a right opening and a left opening for accommodating said right and left mid-frequency drivers respectively, the openings all aligned longitudinally;

e. means for installing said high frequency driver and said right and left mid-frequency drivers in said front chamber corresponding to said center opening and said right and left openings on said front end of said cabinet respectively;

f. a low frequency driver for producing low frequency sound effects of said right and left front channels;

g. said rear chamber of said cabinet having a horizontal opening positioned at approximately the center of said rear chamber for accommodating said low frequency driver;

h. means for installing said low frequency driver in said rear cabinet corresponding to said horizontal opening of said rear chamber;

i. a center channel crossover network located in said front chamber of said cabinet for connecting said high frequency driver and said right and left mid-frequency drivers with said center channel; and j. a front channels crossover network located in said rear chamber of said cabinet for connecting said low frequency driver with said right and left front channels;

k. whereby said high frequency driver and said right and left mid-frequency drivers located in said front chamber of said speaker can produce sound effects of said center channel of said audio system, and said low frequency driver located in said rear chamber of said speaker can produce low frequency sound effects of said right and left front channels of said audio system.

17. The invention as defined in claim 16 wherein said high frequency driver is a tweeter.

18. The invention as defined in claim 16 wherein said right and left mid-frequency drivers are both midranges.

19. The invention as defined in claim 16 wherein said right and left mid-frequency drivers are both full-ranges.

20. The invention as defined in claim 16 wherein said low frequency driver is a subwoofer.

21. The invention as defined in claim 16 wherein said low frequency driver is a woofer.

22. The invention as defined in claim 16 further comprising a generally rectangular shaped grill attachable to said front end of said cabinet for protecting said high frequency driver and said right and left mid-frequency drivers.

23. The invention as defined in claim 16 further comprising a round shaped grill attachable to said cabinet for protecting said low frequency driver.

24. The invention as defined in claim 16 wherein said horizontal opening of said rear chamber for accommodating said low frequency driver is located at said top side of said cabinet.

25. The invention as defined in claim 16 wherein said horizontal opening of said rear chamber for accommodating said low frequency driver is located at said bottom side of said cabinet.

26. The invention as defined in claim 25 further comprising means for elevating said bottom side of said cabinet from a surface upon which said cabinet is placed to create a clearance therebetween.

27. The invention as defined in claim 26 wherein the height of said clearance is approximately one inch (1").

28. The invention as defined in claim 16 wherein said front chamber becomes an air-tight sealed enclosure after said high frequency driver and said right and left mid-frequency drivers are installed in said front chamber.

29. The invention as defined in claim 16 wherein said rear chamber becomes an air-tight sealed enclosure after said low frequency driver is installed in said rear chamber.

30. A speaker for an audio system having four stereo surround sound channels including a right front channel, a left front channel, a rear surround channel and a center channel, the speaker comprising:

a. a cabinet having at least two independent hollow chambers;

b. at least one mid or full range frequency driver installed in one of said at least two independent chambers for producing sound effects of said center channel;

c. at least one low frequency driver installed in the other one of said at least two independent chambers for producing low frequency sound effects of said right and left front channels;

d. a center channel crossover network for connecting said at least one mid or full range frequency driver with said center channel; and e. a front channels crossover network for connecting said at least one low frequency driver with said right and left front channels;

f. whereby said at least one mid or full range frequency driver can produce sound effects of said center channel of said audio system, and said at least one low frequency driver can produce low frequency sound effects of said right and left front channels of said audio system.

31. The invention as defined in claim 30 wherein said mid or full range frequency driver is a midrange, and further comprising at least one tweeter installed in said one of said at least two independent chambers.

32. The invention as defined in claim 30 wherein said at least one low frequency driver is a subwoofer.

33. The invention as defined in claim 30 wherein said at least one low frequency driver is a woofer.

34. The invention as defined in claim 30 wherein each one of said at least two chambers is an independently sealed enclosure.

35. The invention as defined in claim 30 wherein said the other one of said at least two independent hollow chambers, in which said at least one low frequency driver is installed, is a vented enclosure.

36. The invention as defined in claim 30 wherein said at least one mid or full range frequency driver is front-firing.

37. The invention as defined in claim 30 wherein said at least one low frequency driver is up-firing.

38. The invention as defined in claim 30 wherein said at least one low frequency driver is down-firing.

* * * * *